US005108002A

United States Patent [19]

Rowan

[11] Patent Number: 5,108,002

[45] Date of Patent: Apr. 28, 1992

[54] CONTAINER COVER FOR CYLINDRICAL DRUM CONTAINERS

[75] Inventor: Francis J. Rowan, West Chester, Ohio

[73] Assignee: Berenfield Containers, Inc., Mason, Ohio

[21] Appl. No.: 667,187

[22] Filed: Mar. 11, 1991

[51] Int. Cl.[5] ..... B65D 51/20

[52] U.S. Cl. ..... 220/257; 220/378; 220/460; 229/125.16; 229/125.34; 229/125.35

[58] Field of Search ..... 229/125.16, 125.34, 229/125.35; 220/256, 257, 378, 460, 310; 215/298, 341, 347, 349

[56] References Cited

U.S. PATENT DOCUMENTS

| | | | |
|---|---|---|---|
| 389,564 | 9/1888 | Gillingham | 220/378 |
| 983,319 | 2/1911 | Smith | 215/347 |
| 1,739,763 | 12/1929 | Mason | 215/298 |
| 1,850,494 | 2/1930 | Brewer | 215/298 |
| 2,073,415 | 3/1937 | Enkur | 215/347 |
| 2,887,244 | 2/1958 | Betner | 220/257 |
| 3,391,847 | 7/1966 | Christine et al. | 220/257 X |
| 4,545,498 | 10/1985 | Schmid | 215/260 |
| 4,699,188 | 10/1987 | Baker et al. | 215/250 X |
| 4,708,257 | 11/1987 | Deline | 220/257 |

*Primary Examiner*—Stephen Marcus
*Assistant Examiner*—Nova Stucker
*Attorney, Agent, or Firm*—Wood, Herron & Evans

[57] ABSTRACT

A container cover for sealing containers, such as cylindrical drums, has a removable protective sheet adhered thereto for maintaining the cover clean during filling and warehousing of the container. During formation of the cover, a separating agent is provided between the top surface of the container cover and the removable protective sheet. A second sealer sheet, removably adhered to the bottom cover surface, is optionally utilized to act as a gasket between the container cover and the drum. When the container is sealed with such a cover, the protective sheet may be peeled away during shipping to present a clean cover surface to the customer.

7 Claims, 1 Drawing Sheet

CONTAINER COVER FOR CYLINDRICAL DRUM CONTAINERS

BACKGROUND OF THE INVENTION

This invention relates to container covers and lids, more particularly to a cover for sealing drum containers which utilizes a protective sheet on its top surface.

Drums and other containers are commonly used to transport a wide variety of materials. The manufacturing environments where these materials are produced are often dirty and dusty. In addition, some materials are transported in a powdered or fine granular form. Manufacturing plants may be inherently dusty and in those plants producing powdered materials, dust and powder settle on any exposed surface in the plant. With the container cover of a drum being essentially a flat, horizontal surface, it is particularly susceptible to gathering a layer of dust or powdered material while the drum is being filled or warehoused. A dirty container cover detracts from the aesthetics of the drum and may convey to a customer a generally careless attitude on behalf of the manufacturer in preparing and shipping his product. Furthermore, dust and sediment on the container cover might imply to the customer that the contents of the container are contaminated. Whatever the implication, a dirty or dusty container cover reflects negatively on the manufacturer.

The background above illustrates the need for a way to present a clean, dust-free container cover to the customer without unnecessary isolation of the container cover during filling or extensive cleaning of the cover during shipping.

SUMMARY OF THE INVENTION

In a broad aspect of this invention, a container cover is provided which has a protective sheet on its top surface which can be peeled away whenever a clean, dust-free container cover is desired.

More specifically, a thin sheet is removably adhered to a container cover by using a separating agent, such as wax, between the container cover and the thin sheet. The separating agent acts to keep the thin protective sheet secured to the container cover until it is manually stripped away at sometime during the shipping process. The protective sheet generally covers the entire top surface of the container cover and may extend over the sides of the cover somewhat to protect the side portions of the container cover as well. In a preferred embodiment, the container cover is generally circular and is used to cover a cylindrical drum.

In another aspect of this invention, the cover optionally has a second thin sheet on its bottom surface which acts as a gasket when the container cover is fastened to the drum. This second sheet may be the same material as the thin protective sheet on the top surface of the drum cover, and it may also be removably adhered to the bottom surface by the same separating agent. Generally, it is desirable to leave this second sealing sheet intact when shipping or using the container. However, sometimes it may be desirable to remove the sealing sheet to provide a clean cover bottom surface.

In forming the container cover with the protective sheet, a first sheet of material is stacked in an open mold along with a second protective sheet and a separating agent is placed between these two sheets. The mold is then closed to press the sheets together and form the desired shape of the container cover. During forming, heat may be supplied to the mold for softening or melting a separating agent such as wax to create a layer adhering the two sheets together. The separating agent may be placed between the two sheets in a separate step during the formation process. However, preferably the separating agent is precoated on one of the sheet surfaces.

In an alternative method for cover formation, where it is desirable to have a sealer sheet on the bottom surface of the cover to aid in sealing the container, another thin sealing sheet is simply placed in the mold on the first sheet side opposite the protective thin sheet. This sealing sheet preferably has a separating agent between it and the first sheet for easy removability.

The preferred embodiment of the present invention utilizes a circular molded paper fiber thick disc sandwiched between two thinner circular sheets of Kraft paper with a coating of wax between the sheet and discs for removing the sheets from the thick disc. The circular disc and sheets are sandwiched in a heated mold and hydraulically pressed to form the desired container cover shape. In use, the paper fiber container cover is securely fastened to a paper fiber drum by suitable means. The materials of the container, container cover, thin sheets and separating agent may vary. The cover material may be of plastic or metal, and the drum may also be plastic or metal. Furthermore, the separating agent may be any material which facilitates sufficient adherence of protective cover materials during use but allows easy manual removal of the protective sheet during sealing and shipping.

The container cover described herein is directed to a drum cover; however, the invention encompasses any shipping container utilized in dirty and dusty manufacturing environments as will be understood with reference to the following detailed description.

DETAILED DESCRIPTION OF THE INVENTION

The container cover 1 of this invention is adapted to seal a container 2 such as a drum where the drum is filled or warehoused in a dirty or dusty environment. The cover 1 will generally be of a circular shape for sealing a cylindrical drum, such as a paper fiber drum, or other plastic or metal containers used in shipping a variety of materials. The invention is particularly useful for filling, packaging and shipping powders or fine granules because they present the problem in the manufacturing environment that this invention solves.

Figure 1:
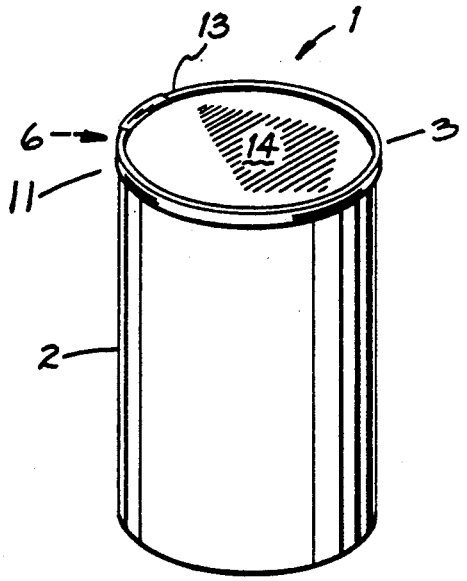
FIG. 1 is a formed container cover with protective and sealing sheets fitted to a drum.
Figure 2:
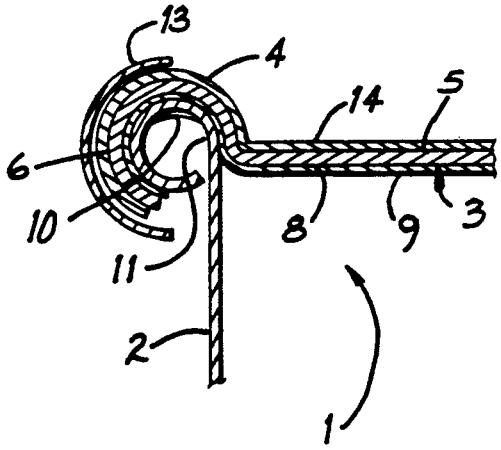
FIG. 2 is a cross-sectional view of the container cover of FIG. 1 showing cover and protective sheets in relation to sealing ring and drum.

Referring to FIG. 2, the container cover 1 includes a rigid or semi-rigid cover body 3 which has a protective sheet 4 removably adhered to its top surface 5. The protective sheet 4 protects the entire top surface 5 of the cover body 3 and preferably extends over a contoured lip 6 of the cover body 3 for the sheet to protect the sides of the cover body 3. As indicated above, removable adherence of the protective sheet 4 to the cover body 3 is accomplished by a separating agent 7 which is placed between the cover body 3 and the protective sheet 4. The separating agent 7 must have the ability to securely hold the protective sheet 4 to the top surface 5 of the cover body 3 when it is being used during storage, filling of the container 2, sealing and shipment. On the other hand, the separating agent 7 must also allow the protective sheet 4 to be readily peeled from the top surface 5 of the cover body 3 whenever desired during shipping (see FIG. 4). In one form, the protective sheet 4 for a paper fiber cover is a thin, krinkly sheet of Kraft paper. Other materials, however, may be more suitable when the cover is plastic or metal. For example, plastic films or sheets may be used and heat sealed to form the cover with removable protective sheets. Polyethylene, polypropylene polystyrene, polyvinyl chloride, polycarbonate, and other polymers, may be employed as cover or even container materials. Metals such as steel, aluminum, or metal alloys, may also be used for the containers or covers.

Another aspect of the invention is to have a sealing sheet 9 removably adhered to the bottom surface 8 of the cover body 3 to face inward towards the lading contents of the drum and to act as a sealing gasket. The sealing sheet 9 extends over the entire bottom surface 8 of the cover body 3 and over any contoured grooves 10 in the drum top 11 which aid in fitting the cover 1 to the drum or other container 2. This allows the sealing sheet 9 to be sandwiched between the cover body 3 and drum top 11 to create an effective seal.

Figure 3:
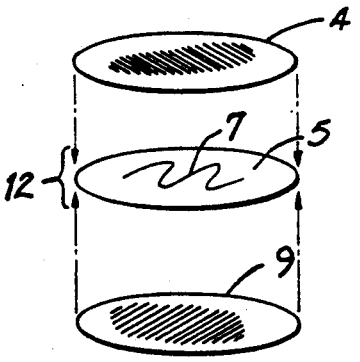
FIG. 3 shows stacking of disc, sheets, and separating agent during molding process.

As shown in FIG. 3, in a presently preferred method, a thick paper fiber disc 12 having a generally circular shape is used for covering the top 11 of a cylindrical drum 2. The circular protective sheet 4 is placed on one side of the disc. If a sealing sheet 9 is also utilized, then it will be placed on the other side of the disc 12. The disc 12 and sheets 4 and 9 are then stacked in a mold with a separating agent 7 between them. The separating agent 7 is placed between the sheets 4 and 9 prior to stacking them or it is precoated onto a sheet or disc surface.

Once the sheets 4 and 9 have been stacked in the mold, the mold is closed with sufficient pressure to force the disc 12 and sheets 4 and 9 into the desired shape of the container cover 1. As the disc 12 and sheets 4 and/or 9 are pressed in the mold, heat may be applied to soften or melt the separating agent 7, such as wax, to allow uniform bonding of the sheet 4 and/or 9. Pursuant to this method, a metal mold supplies quick uniform heat to the pressed sheets. A recommended method utilizes a heated aluminum mold at a temperature of about 300° F. which is pressed in a hydraulic press at about 850 psi for about 3.5 seconds. This recommended method is used for paper fiber discs 12 having thin, krinkled paper for protective sheets 4 and wax as a separating agent 7 between the discs 12 and sheets 4. The temperature, pressure and dwell time have to be adjusted accordingly for different disc materials, sheet materials, separating agents and mold/press setups as understood to one of ordinary skill in view of this description. When the container cover body 3 is plastic or metal, wax may not bind a paper sheet to the surface sufficiently, and other materials will be necessary. Furthermore, the protective sheet 4 itself may be of a different material and may require a different separating agent 7 for effective bonding, for instance. As indicated above, when plastic materials are used for the cover body 3 or protective sheet 4, the inherent melt bonding property of the plastic may be used to make the cover 1 having the removable thin protective sheet 4.

Figure 4:
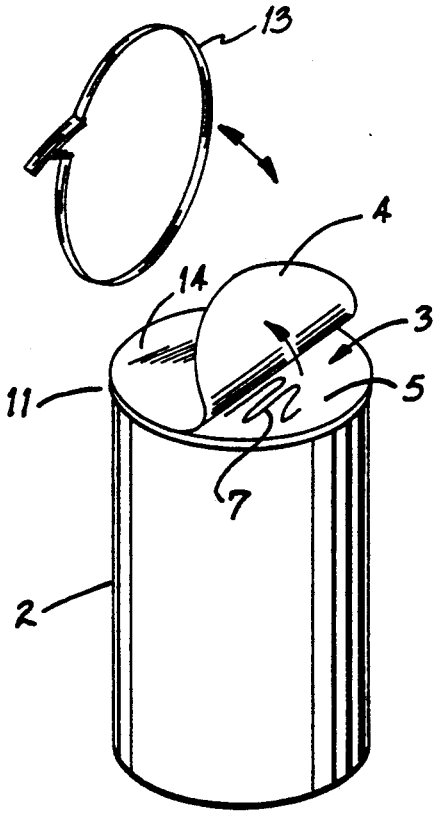
FIG. 4 shows protective sheet of container cover partially peeled away to expose clean cover surface.

Once a container cover 1 with a protective sheet has been formed, it is relatively easy to use. The cover 1 is placed on a drum or container 2 filled with lading, and is held in place by a sealing ring 13, a clamp or some other securing apparatus. The sealed container can be warehoused and stacked without concern for the cleanliness of the top surface 14 of the cover 1. Referring to FIG. 4, at anytime during storage or shipping, the sealing means 13 can be removed and the protective sheet 4 can be easily peeled away from the cover body 3 to present a clean, dust-free surface to the customer.

Having described this invention, other forms or variations thereof will be obvious to one of ordinary skill in the art. Equivalents may be substituted for elements without departing from the scope of the invention, and therefore it is intended that the invention not be limited to the particular embodiment disclosed as the best mode contemplated for carrying out this invention. The invention will include all embodiments falling within the scope of the appended claims.

What is claimed is:

1. A container cover for use with cylindrical drum containers having a removable surface sheet for cleanliness purposes comprising:

a circular cover for removable securement to a cylindrical drum container top for sealing said drum container, said removable cover having top and bottom surfaces and a peripheral lip to engage the top edge of the cylindrical drum;

a thin peelable protective sheet removably adhered on the entire cover top surface, and extending over the peripheral lip of said cover;

a removable sealing ring to secure said cover on said cylindrical drum, and to secure said peelable sheet to the peripheral lip of said removable cover;

wherein the peelable sheet is secured to said removable cover for maintaining the container cover clean during filling and warehousing of the drum container, and whereby said ring can be removed and said sheet peeled away to present a clean drum top during shipping of the drum.

2. The container cover of claim 1 wherein said cover is made of paper fibers and said protective sheet is a thin paper sheet.

3. The container cover of claim 1 comprising a thin sealing sheet removably adhered on said cover bottom surface, said sealing sheet utilized as a gasket between said cover and a container.

4. The container cover of claim 1 wherein said container is made from a material selected from the group consisting of paper fiber, plastic and metal, and wherein said cover is made from a material selected from the group consisting of paper fiber, plastic and metal.

5. The container cover of claim 3 wherein said cover is paper fiber and said protective and sealing sheets are tin paper sheets and further wherein there is a separating agent between the cover and at least one of said sheets.

6. The container cover of claim 3 wherein said container is made from a material selected from the group consisting of paper fiber, plastic and metal, and wherein said cover is made from a material selected from the group consisting of paper fiber, plastic and metal.

7. A method for using a container cover of claim 1 comprising:

filling a cylindrical drum container having an open top with lading;

placing said circular container cover on the top of the filled drum container with said peelable sheet exposed;

placing said sealing ring around said container cover to secure said cover to the drum and to secure said peelable sheet to the cover thus sealing said container and protecting said cover during filling and warehousing;

removing said sealing ring, peeling said protective sheet from said top cover surface and replacing said sealing ring during shipping to provide a clean drum top.

* * * * *